US005377388A

United States Patent [19]

DeBever

[11] Patent Number: 5,377,388

[45] Date of Patent: Jan. 3, 1995

[54] SAFETY CAP

[75] Inventor: Bruce J. DeBever, Whittier, Calif.

[73] Assignee: Decor Concepts, Inc., Arcadia, Calif.

[21] Appl. No.: 173,769

[22] Filed: Dec. 27, 1993

[51] Int. Cl.[6] ..... B65D 63/10

[52] U.S. Cl. ..... 24/16 PB; 292/319

[58] Field of Search ..... 24/16 R, 16 PB, 633, 24/573.1; 292/318–322; 248/74.3

[56] References Cited

U.S. PATENT DOCUMENTS 4,306,745 12/1981 Wenk ..... 292/318

4,902,055 2/1990 Scott et al. ..... 292/319

FOREIGN PATENT DOCUMENTS

WO84/01275 4/1984 WIPO ..... 24/633

*Primary Examiner*—James R. Brittain

*Attorney, Agent, or Firm*—Lyon & Lyon

[57] ABSTRACT

A safety cap for a tie of the type employing a tie strap and a tie head where the tie strap extends through a passageway in the tie head. The cap includes a hollow body having flanges across an open side thereof to retain a tie head within the cavity. The ribs are provided along two opposite sidewalls. In the other opposite sidewalls, two ribs extend inwardly to form a tighter fit for the tie head. These ribs define lines of contact which are displaced to either side of a tie head with one lying in a horizontal plane and the other lying in a vertical plane.

3 Claims, 2 Drawing Sheets

SAFETY CAP

BACKGROUND OF THE INVENTION

The field of the present invention is safety mechanisms for covering protruding elements.

Commercial play yards for children such as those associated with fast food restaurants have been developed for the safe entertainment of children. Most commonly, such play yards have a structural frame of 2" pipe with foam padding wrapped about the full length of pipe where it is accessible by children using the equipment. The wrapping is frequently of 1" foamed plastic extruded in a tube configuration with an inner diameter approximately the outer diameter of the pipe to which it is to be associated. To assemble the padding with the pipe, the padding tube is slit longitudinally almost through. Sheets wrapped about the pipe may also be used. The pipe is then covered such that the padding has an abutting slit or seam parallel to the axis of the pipe.

To retain the padding in place on the pipe frame, plastic ties are employed. These ties include a tie strap and a tie head. The tie strap and head are integrally formed. The head includes a passageway therethrough with a locking element to receive and grip the end of the tie strap when brought into a loop with the head.

In operation, padding is placed on the pipe and ties are looped about the padding with the ends of the tie straps being locked into the tie heads, respectively. As excessive length is provided on the tie strap, once the tie is tightly positioned on the padding, the excess tie strap extending from the tie head is cut off. The resulting new end of the tie strap may then be heated to blunt the edges thereof. However, the head itself as well as the end of the tie strap does provide a rigid protruding element on the padding which may hurt a youngster falling against the frame at the tie head.

SUMMARY OF THE INVENTION

For play yards such as described above, the present invention is directed to a safety cap designed to securely cover the tie head and the trimmed end of the tie strap. To this end, a cap having a hollow body with an open bottom is employed. The cap has flanges extending inwardly at the open bottom to receive and lock a tie head. To overcome dimensional instability, either in the tie head or in the cap, and to insure secure retention of the cap on the head, two ribs are provided, a first rib near the top of the hollow body extending across one wall and a second rib on an opposite wall tapered into the cavity as it approaches the top of the hollow body.

As a separate point of invention, the aforementioned safety cap may employ the first and second ribs such that each has a line of contact extending to the tie head. To accommodate problems of fit, the lines of contact may lie in perpendicular planes.

Accordingly, it is an object of the present invention to provide a safety cap for padding tie heads on play yard equipment. Other and further objects and advantages will appear hereinafter.

DETAILED DESCRIPTION OF THE PREFERRED EMBODIMENT

Figure 1:
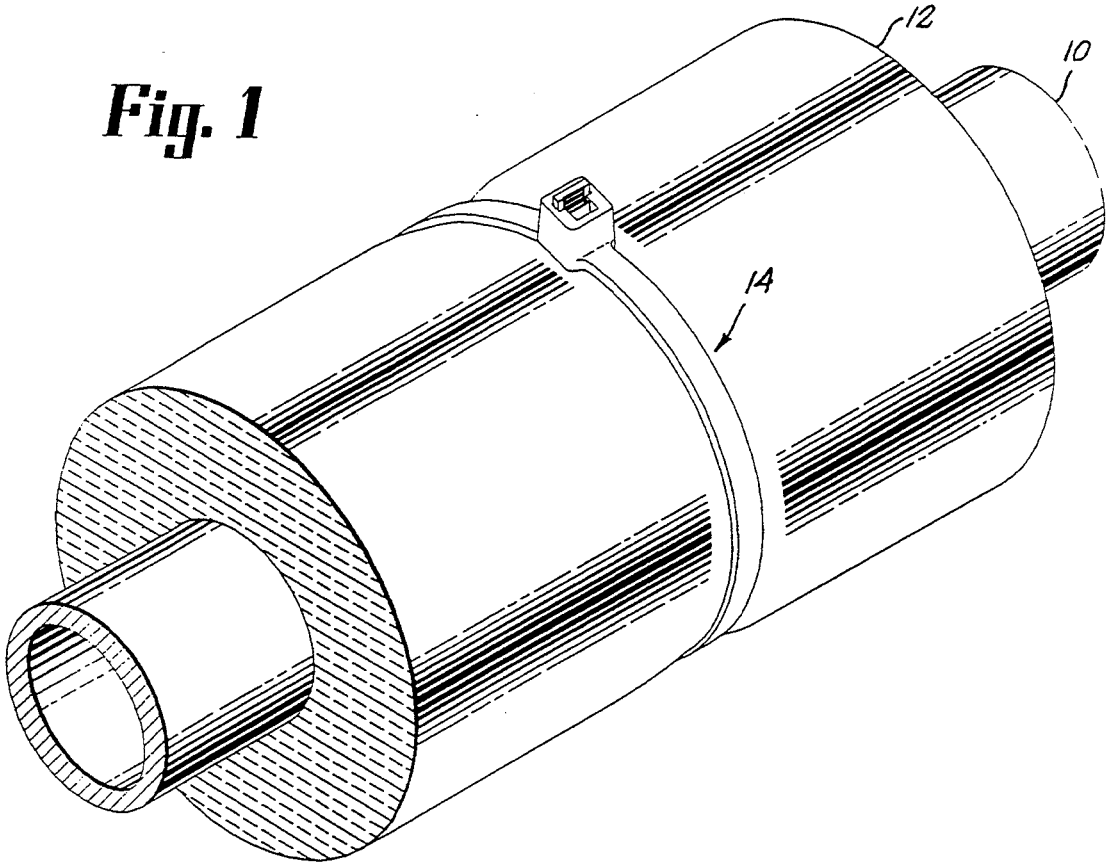
FIG. 1 is a perspective view of a portion of a frame, the padding therefor and a tie to hold the padding in place.
Figure 2:
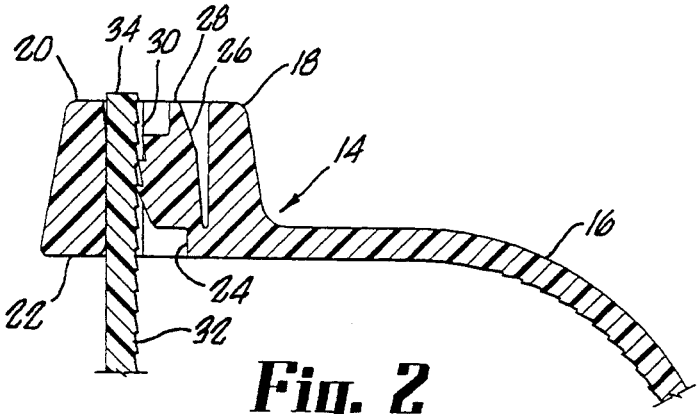
FIG. 2 is a cross-sectional side view of a tie with the tie strip inserted in the tie head and trimmed.
Figure 3:
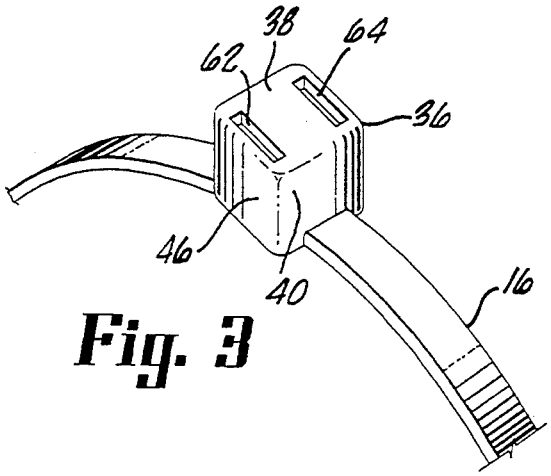
FIG. 3 is a perspective view of a tie with a safety cap thereon.

Turning in detail to the drawings, FIG. 1 illustrates a portion of a pipe frame such as used in play yard equipment. The pipe 10 is typically 2" OD steel. Surrounding the pipe 10 is a layer of padding 12 of foam material forming a protective tube. The padding tube may be slit either substantially through or fully through so as to allow placement on the pipe 10.

To fully secure the padding 12 on the pipe 10, flexible ties, generally designated 14 are employed. The ties 14 each include a tie strap 16 of sufficient length to fully wrap about the padding 12. Also included is a tie head 18. The tie head 18 has a substantially rectangular cross section taken in plan. The top 20 and bottom 22 are conveniently parallel. The four sides have a draft tapering inwardly toward the top.

A passageway 24 extends vertically through the tie head 18. A locking element 26 is integrally formed with the tie head 18 such that it extends across the passageway 24. The locking element 26 has a release tab 28 extending to the upper end of the passageway 24 such that the locking element 26 may be manually withdrawn from extending across the passageway 24. Teeth 30 are provided along one side of the locking element 26. The tie strap 16 includes teeth 32 which, when the tie strap 16 is bent around and threaded through the passageway 24, interlock with the teeth 30 on the locking element 26. Until the locking element 26 is withdrawn from engagement with the tie strap 16 by means of the release tab 28, the teeth 30 and 32 prevent withdrawal of the end of the tie strap 16. Tie straps 16 are made such that they are longer than is required to circumscribe the padding 12. This provides for ease of assembly and for variations in padding thickness.

During assembly, the tie straps 16 are wrapped about the padding 12 and threaded through the passageway 24 to an extent that compression is imposed upon the padding 12. Thus, the tie strap 16 remains in tension and the teeth 30 and 32 of the tie 14 remain engaged. The end of the tie strap 16 protruding from the tie head 18 is trimmed off as close as possible to the top 20 of the tie head 18. To blunt the edges of the resulting end of the tie strap 16, heat is typically applied to the trimmed end 34.

A safety cap 36 is positioned over the tie head 18 of a positioned and assembled tie 14. The cap 36 is generally defined by a hollow body having a top wall 38, two opposed first walls 40 and 42 and two opposed second walls 44 and 46. The walls 40–46 present a generally rectangular cross section. The walls do not have any significant draft. The hollow body has an open bottom defined at the lower determination of the walls 40–46. A notch 48 in the wall 40 accommodates the tie strap 16 extending from the tie head 18.

Figure 5:
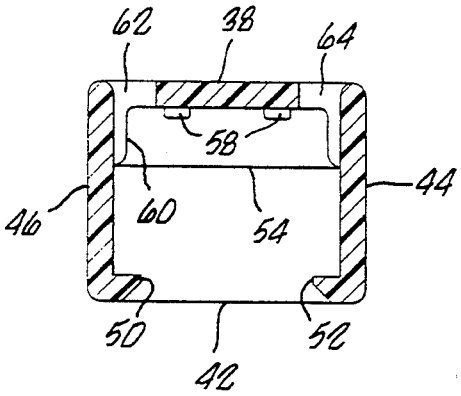
FIG. 5 is a cross-sectional view taken vertically through the center of the cap and looking toward the back thereof
Figure 6:
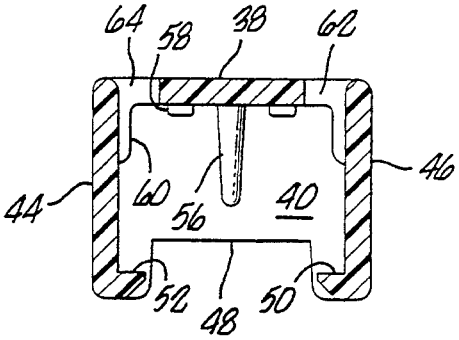
FIG. 6 is a cross-sectional view taken vertically through the center of the cap and looking toward the front thereof.

To retain the cap 36 in place, flanges 50 and 52 extend inwardly across the open bottom. The cap 36 is principally to protect children against scratches and the like which might occur under the condition of a child falling against the tie head 18. Thus, the cap 36 is designed to be most useful under high stress conditions. The flanges 50 and 52 are designed such that they can be installed with a reasonable amount of force and yet are very difficult to remove. To this end, the outer surface of each flange 50 and 52, the surface facing outwardly of the hollow body, is tapered inwardly as can best be seen in FIGS. 5 and 6. These tapers on the flanges 50 and 52 present reaction forces when the cap 36 is forced onto the tie head 18 such that the walls 42 and 46 will deform as well as the flanges 50 and 52 to permit full entry of the tie head 18 into the cavity of the hollow cap 36. The inner surfaces of the flanges 50 and 52 extend roughly parallel to the open bottom of the hollow body.

Figure 7:
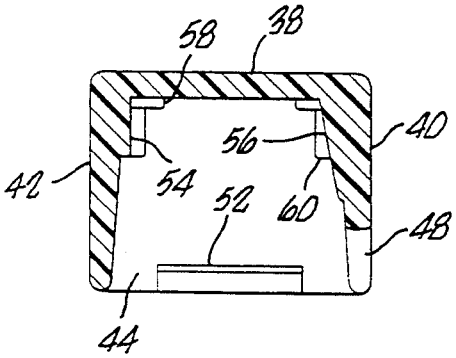
FIG. 7 is a cross-sectional view taken vertically through the center of the cap and looking toward one side thereof.

The flanges 50 and 52 further extend along a significant portion of the walls 42 and 46, as can best be seen in FIG. 7. The arrangement of the flanges 50 and 52 is such that maximum resistance to removal is understood to occur in a sheering direction parallel to the long axis of the underlying frame. This is because the entire flange must be overcome to lift the cap 36 from the tie head 18. A sheering motion in the other direction, in the plane containing the tie strap, would tip the cap 36 relative to the tie head 18 so as to be resisted only by one end of each flange 50 and 52. Thus, less resistance is provided as the entire flange is not concurrently resisting removal.

Figure 4:
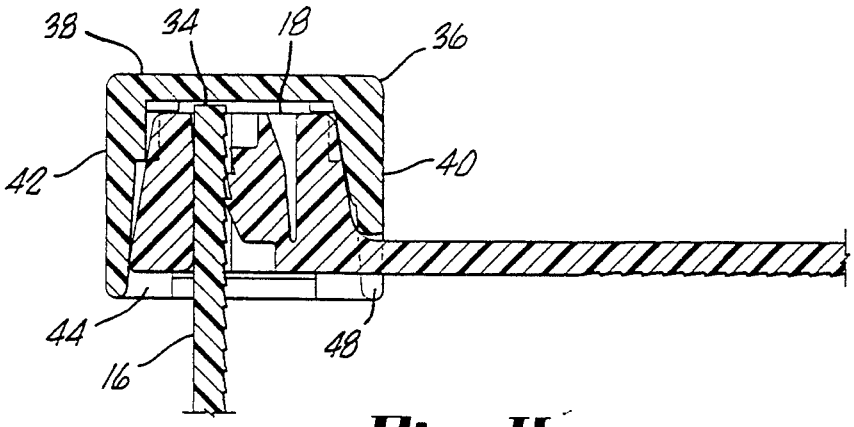
FIG. 4 is a cross-sectional view as in FIG. 2 with the safety cap in place.

To assist in resistance to removal of the cap 36 from sheering action within the plane of the tie strap 16, ribs are provided to prevent significant tipping of the cap 36 relative to the tie head 18. A first rib 54 extends across the wail 44 adjacent the top wall 38. This first rib 54 accommodates the space between the relatively straight-sided wall 44 and the body of the tie head 18 resulting from the draft on the tie head. Substantially a line contact between the rib 54 and the side of the tie head 18 is achieved with the cap 36 in place. The line contact is able to transmit significant pressures on the rib 54 so as to partially deform the rib if the fit is somewhat in interference. Thus, a range of dimensional anomaly can be tolerated in providing a tight fit. A second rib 56 extends inwardly of the sidewall 40 above the notch 48. The second rib 56 is narrow so as to accommodate some potential misalignment or asymmetry in the parts. The rib 56 is tapered inwardly as it approaches the top wall 38 such that it provides a ridge line having a similar angle to the draft of the tie head 18. Reference is made to the fit as illustrated in FIG. 4. As with the first rib 54, the second rib 56 provides a narrow line of contact with the tie head 18. However, the two ribs 54 and 56 are disposed such that the lines of contact with the tie head 18 lie in perpendicular planes to one another. Thus, some dimensional anomalies can be accommodated and yet the tie head 18 is securely held within the cap 36. This prevents the cap from being rotated in a manner that would allow the bottom of the tie head to encounter one end of the flanges 50 and 52 at a significant angle such that the cap 36 may be peeled from the tie head 18 without significant resistance.

Other small elements extend into the cavity of the hollow body to assist in placement and fit. Four stops 58 extend from the top wall 38. Corner members 60 are also located at each wall intersection adjacent the top of the cap 36 within the cavity thereof. Two holes 62 and 64 extend through the top wall 38. These holes are arranged such that the trimmed end 34 of the tie strip 16 is not aligned to extend therethrough. The holes 62 and 64 are provided to allow a die fixture to extend within the cavity of the hollow body to define a portion of the inner surfaces of the walls 42 and 44 and the inner surfaces of the flanges 50 and 52.

Accordingly, a safety cap is provided for employment with the tie head of a tie commonly employed in securing padding on a play structure. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A cap for a tie head of substantially rectangular cross section in plan having a top, a bottom and sides, each side having a draft tapering inwardly toward the top, comprising a hollow body having four side walls, a top wall and an open bottom;

flanges extending inwardly from two opposed first walls of said four side walls partially across said open bottom, said flanges having outer surfaces which are tapered inwardly for facile introduction of the tie head and inner surfaces extending parallel to said open bottom to prevent extraction of the tie head once positioned;

a first rib extending across the inside of one of two opposed second walls of said four side walls adjacent said top wall;

a second rib extending down the inside center of the other of said two opposed second walls of said four side walls from adjacent said top wall, said second rib being tapered to extend further into said hollow body toward said top wall.

2. The cap of claim 1 wherein one or the other of said two opposed second walls of said four side walls includes a notch adjacent said open bottom.

3. A cap for a tie head of substantially rectangular cross section in plan having a top, a bottom and sides, each side having a draft tapering inwardly toward the top, comprising a hollow body having four side walls, a top wall and an open bottom;

flanges extending inwardly from two opposed first walls of said four side walls partially across said open bottom; said flanges having outer surfaces which are tapered inwardly for facile introduction of the tie head and inner surfaces extending parallel to said open bottom to prevent extraction of the tie head once positioned;

a first rib extending across the inside of one of two opposed second walls of said four side walls adjacent said top wall and including a first line of contact with the tie head;

a second rib extending down the inside center of the other of said two opposed second walls of said four side walls from adjacent said top wall, said second rib being tapered to extend further into said hollow body toward said top wall and including a second line of contact with the tie head, said first and second lines of contact lying in perpendicular planes, respectively.

* * * * *